US005814204A

United States Patent [19]

D'Muhala

[11] Patent Number: 5,814,204

[45] Date of Patent: Sep. 29, 1998

[54] ELECTROLYTIC DECONTAMINATION PROCESSES

[75] Inventor: Thomas F. D'Muhala, Raleigh, N.C.

[73] Assignee: Corpex Technologies, Inc., Morrisville, N.C.

[21] Appl. No.: 730,492

[22] Filed: Oct. 11, 1996

[51] Int. Cl.[6] ..... C25F 1/00

[52] U.S. Cl. ..... 205/705; 205/712; 205/717; 205/722

[58] Field of Search ..... 205/705, 712, 205/717, 722

[56] References Cited

U.S. PATENT DOCUMENTS

| | | | |
|---|---|---|---|
| 3,244,605 | 4/1966 | Hotchkiss et al. | 204/153 |
| 3,459,646 | 8/1969 | Carlson | 204/153 |
| 3,496,017 | 2/1970 | Weed et al. | 134/2 |
| 3,664,870 | 5/1972 | Oberhofer et al. | 134/3 |
| 3,873,362 | 3/1975 | Mihram et al. | 134/3 |
| 3,970,239 | 7/1976 | Hill | 228/220 |
| 4,098,658 | 7/1978 | Ginatta | 204/114 |
| 4,098,698 | 7/1978 | Ginatta | 204/114 |
| 4,110,190 | 8/1978 | Vissar | 204/224 |
| 4,162,229 | 7/1979 | Loewenschuss | 252/301.1 |
| 4,172,786 | 10/1979 | Humphrey et al. | 210/57 |
| 4,193,853 | 3/1980 | Childs et al. | 204/129.95 |
| 4,226,640 | 10/1980 | Bertholdt | 134/3 |
| 4,287,002 | 9/1981 | Torok | 134/3 |
| 4,318,786 | 3/1982 | Lahoda et al. | 204/141.5 |
| 4,437,999 | 3/1984 | Mayne | 210/748 |
| 4,452,643 | 6/1984 | Martin et al. | 134/3 |
| 4,470,951 | 9/1984 | Bradbury et al. | 376/310 |
| 4,476,047 | 10/1984 | Bonnici et al. | 252/626 |
| 4,512,921 | 4/1985 | Anstine et al. | 252/626 |
| 4,514,270 | 4/1985 | Furutani et al. | 205/702 |
| 4,537,666 | 8/1985 | Murray et al. | 204/129.95 |
| 4,540,443 | 9/1985 | Barber | 134/2 |
| 4,544,462 | 10/1985 | Furutani et al. | 204/129 |
| 4,587,043 | 5/1986 | Murray et al. | 252/626 |
| 4,609,757 | 9/1986 | D'Muhala et al. | 564/151 |
| 4,657,596 | 4/1987 | Murray et al. | 134/3 |
| 4,659,512 | 4/1987 | Macedo et al. | 252/629 |
| 4,685,971 | 8/1987 | Murray et al. | 134/2 |
| 4,693,833 | 9/1987 | Toshikuni et al. | 210/759 |
| 4,704,235 | 11/1987 | Arvesen | 252/626 |
| 4,708,805 | 11/1987 | D'Muhala | 210/698 |
| 4,726,907 | 2/1988 | D'Muhala | 252/82 |
| 4,729,855 | 3/1988 | Murray et al. | 252/626 |
| 4,747,954 | 5/1988 | Vaughn et al. | 210/670 |
| 4,762,693 | 8/1988 | Schimmel et al. | 423/321 S |
| 4,775,491 | 10/1988 | D'Muhala et al. | 252/180 |
| 4,792,385 | 12/1988 | Snyder et al. | 204/140 |
| 4,798,675 | 1/1989 | Lipinski et al. | 210/700 |
| 4,810,343 | 3/1989 | Bonnardel | 204/224 |
| 4,828,790 | 5/1989 | Honda et al. | 376/306 |
| 4,836,900 | 6/1989 | Bellanger | 204/140 |
| 4,845,125 | 7/1989 | Geier | 514/561 |

(List continued on next page.)

OTHER PUBLICATIONS

Gray, Radioactive materials could pose problems for the gas industry, *Oil & Gass Journal* (1990).

*Primary Examiner*—Arun S. Phasge
*Attorney, Agent, or Firm*—Myers Bigel Sibley & Sajovec

[57] ABSTRACT

The invention relates to processes of decontaminating by electrochemical attack, a metal workpiece or solution contaminated with one or more metal oxides. A metal workpiece or solution contaminated with one or metal oxides is mixed or exposed to a solution including hydrazide ions to complex metal ions of the metal oxides with hydrazide ions. The metal workpiece or an anode is connected to a positive terminal of means for providing direct current. A cathode is disposed away from the metal workpiece in the solution including metal ions complexed with hydrazide ions and connecting the cathode to a negative terminal of means for providing direct current. DC current is conducted from the metal workpiece through the solution including metal ions complexed with hydrazide ions to the cathode. The solution or workpiece is decontaminated by plating out the metal ion as a metal at the cathode thereby removing the metal oxides from the metal workpiece or solution.

11 Claims, 3 Drawing Sheets

U.S. PATENT DOCUMENTS

| | | | |
|---|---|---|---|
| 4,880,559 | 11/1989 | Murray et al. | 252/186.21 |
| 4,913,849 | 4/1990 | Husain | 252/626 |
| 4,973,201 | 11/1990 | Paul et al. | 405/264 |
| 4,980,077 | 12/1990 | Morris et al. | 252/82 |
| 5,026,481 | 6/1991 | Paul et al. | 210/638 |
| 5,032,280 | 7/1991 | Paul et al. | 210/643 |
| 5,045,273 | 9/1991 | Gassen et al. | 376/309 |
| 5,059,333 | 10/1991 | Hen | 252/8.552 |
| 5,068,042 | 11/1991 | Hen | 252/8.552 |
| 5,081,105 | 1/1992 | Morris et al. | 134/3 |
| 5,085,709 | 2/1992 | Morris et al. | 134/3 |
| 5,089,217 | 2/1992 | Corpora et al. | 376/313 |
| 5,093,072 | 3/1992 | Guy et al. | 376/313 |
| 5,093,073 | 3/1992 | Schenker | 376/310 |
| 5,111,887 | 5/1992 | Morris et al. | 166/312 |
| 5,133,871 | 7/1992 | Levy | 210/688 |
| 5,151,196 | 9/1992 | Paul et al. | 210/712 |
| 5,154,197 | 10/1992 | Auld et al. | 134/1 |
| 5,154,776 | 10/1992 | Bloch | 134/22.1 |
| 5,196,124 | 3/1993 | Connor et al. | 210/679 |
| 5,200,117 | 4/1993 | Morris et al. | 252/626 |
| 5,207,532 | 5/1993 | Mason et al. | 405/128 |
| 5,322,644 | 6/1994 | Dunn et al. | 252/626 |
| 5,342,449 | 8/1994 | Holbein et al. | 134/2 |
| 5,358,549 | 10/1994 | Nagel et al. | 75/414 |
| 5,407,544 | 4/1995 | Oehr et al. | 205/710 |
| 5,459,066 | 10/1995 | Mestetsky et al. | 435/266 |
| 5,462,607 | 10/1995 | Mestetsky et al. | 134/22.12 |
| 5,468,303 | 11/1995 | Thomas, Jr. | 134/3 |
| 5,489,735 | 2/1996 | D'Muhala | 588/1 |

ELECTROLYTIC DECONTAMINATION PROCESSES

FIELD OF THE INVENTION

This invention relates to a decontamination process and, more particularly, to electrolytic decontamination processes.

BACKGROUND OF THE INVENTION

Industrial plant equipment, machinery and components or products produced or used therein are typically exposed to undesirable contaminants such as oil, grease, hydrocarbons, and the like. When these components or equipment are made out of metallic materials, the surfaces are also subject to various types of oxidation in addition to the deposition of the other types undesirable surface contaminants.

These contaminants need to be removed from the part in a manner which minimizes any non-desirable secondary effects on the underlying metal, such as corrosion and pitting. Additionally, in situations wherein the part is subject to subsequent processing such as plating or coating, the cleaning must remove substantially all of the contaminant without eating into the base metal to expose the surface of the base metal so that the part can be properly and uniformly coated.

Conventionally, methods or processes for cleaning or decontaminating metallic workpieces and components have been done with the use of a cleaner which has corrosive tendencies, such as with acids. However, not only is the corrosive potentially harmful to the workpiece, it also has negative environmental and worker health consequences.

One proposed decontamination method is as illustrated in U.S. Pat. No. 4,318,786 by Lahoda et al. titled "Electrolytic Decontamination". This decontamination method is directed to decontaminating equipment contained within nuclear power plants. This method employs electrolytic cleaning and proposes placing the component in a chamber and spraying an electrolyte cleaner typically comprising sulfuric acid through a nozzle directed at the component while maintaining an electrical potential between the nozzle and the apparatus. Notably, the electrolytic cleaning method exposes the component or equipment to the possibility of corrosion. Lahoda et al. attempts to control this corrosion by limiting the exposure time of the part to the electrolyte cleaner. However, the exposure time is dependent on multiple variables such as the amount and type of build up present on the equipment to be decontaminated as well as the configuration of the equipment or workpiece itself. Therefore, regulating exposure time introduces the possibility of either an under-cleaned part which can hamper subsequent processing or a part which has been overcleaned which exposes the base metal to the corrosive. Additionally, leaving traces of corrosive on metal can introduce latent and potentially destructive material deficiencies because the corrosive can eat into the very grain of the metal and weaken the functionality of the hardware.

U.S. Pat. No. 4,810,343 issued to Bonnardel titled "Installation For Carrying Out Localized Electrolytic Surface Treatments" also proposes employing a corrosive type electrolyte in a mobile apparatus which targets specific and localized areas of a workpiece. Like the process described above, the use of this type of cleaning process exposes the workpiece as well as personnel—and even the environment at an eventual disposal point—to hazardous processing materials.

Other cleaning or decontamination methods use non-corrosive cleaners but typically fail to effectively clean the oxidized contaminants on the hardware. One example of a decontamination method which describes an alternative and non-corrosive cleaner is illustrated in U.S. Pat. No. 5,462,607 by Mestetsky et al. titled "Method of Cleaning Using a Foamed Liquid." This method typically heats a cleaning solution comprising non-ionic water soluble surfactant and enzymes to introduce foaming bubbles to clean and remove grease and hydrocarbons off internal surfaces of industrial equipment. However, Mestetsky et al. '607 fails to disclose the effective decontamination of metallic oxides off the metallic surfaces.

An additional concern with a liquid cleaning solution is its "life" or the amount of time at which it can consistently perform effective cleaning. Unfortunately, the shorter the life of the cleaner, the more chemical waste is produced by the cleaning and decontamination process. The life of the cleaner is typically shortened because it builds up contaminants within the solution causing it to be less effective, eventually resulting in the solution becoming a waste product which must be disposed. It follows then that the more chemical waste which must be disposed of results in potentially larger hazards for the environment as well as additional labor costs to oversee the disposal into landfills or hazardous storage—which is closely regulated by governmental agencies.

One way to "extend" the life of the cleaner is to reclaim and recycle it, such as is done in closed loop cleaning systems, such as that illustrated in Lahoda et al. '786. Lahoda collects the used electrolyte and pumps it back through the system, typically filtering out contaminants and recirculating the electrolyte to be used in the decontaminating system. The installation as illustrated by Bonnardel '343 does not enclose the component in a chamber and thereby recapture the electrolyte, instead, Bonnardel '343 proposes using a suction means to bring the used electrolyte back to the reservoir. However, neither of these references extend the effective life of the electrolyte and thereby reduce the amount of electrolytic liquid waste introduced by the industrial decontamination process.

U.S. Pat. No. 5,459,066 issued to Mestetsky titled "Method of Separating Oily Materials From Wash Water" proposes to separate oil, grease, dirt and the like from the wash water. The cleaning substance comprises a surfactant and enzyme which stratifies the dispersed contaminants therein to form layers which are removable by, for example, a bilge pump to pump off the desired layer of oil to be recaptured. However, this separating method does not extend the life of the liquid processing solution to thereby reduce the amount of waste, rather, it acts to separate the various dispersed contaminant layers for easier removal and disposal.

SUMMARY OF THE INVENTION

In view of the foregoing, it is therefore an object of the present invention to provide a cleaning and decontamination process for metallic parts which is effective, non-corrosive to the workpiece, and which minimizes environmental disposal and worker safety concerns.

It is also an object of the present invention to provide processes for cleaning and decontaminating liquids with inorganic metal compounds so as to minimize industrial processing liquid waste, reduce worker exposure to radiation, and facilitate uniform plating.

The present invention provides many advantages one of which, for example, is that the decontamination process preferably employs an environmentally friendly electrolyte solution including hydrazide ions. This type of solution is biodegradable and can replace corrosive acids conventionally associated with electrolyte decontamination processes which is particularly advantageous in corrosion susceptible materials.

More particularly, one aspect of the present invention provides a process of decontaminating by electrochemical attack a metal workpiece contaminated with one or more metal oxides. The process comprises several steps. The first step includes placing the metal workpiece contaminated with one or more metal oxides, in a solution including hydrazide ions to complex metal ions of the metal oxides with hydrazide ions, and connecting the metal workpiece to a positive terminal of means for providing direct current. A second step includes placing a cathode in the solution including metal ions complexed with hydrazide ions and connecting the cathode to a negative terminal of means for providing direct current. A third step includes conducting current from the metal workpiece through the solution including metal ions complexed with hydrazide ions to the cathode. And a fourth step includes plating out the metal ion as a metal at the cathode thereby removing the metal oxides from the metal workpiece.

An additional aspect of the present invention provides a process of decontaminating by electrochemical attack a liquid contaminated with inorganic metal compounds. The process comprises a plurality of steps. A first step includes mixing a liquid contaminated with inorganic metal compounds with a solution including hydrazide ions to chelate the inorganic metal compound to the hydrazide ions. A second step is placing an anode and a cathode in the mixture provided in step (a), and connecting the anode and cathode to the positive and negative terminals, respectively of means for providing direct current. A third step is conducting current from the anode through the mixture provided in step (a) to the cathode to deposit the inorganic metals on the cathode thereby removing the inorganic metal ions from the contaminated liquid.

An advantage of the present invention is that the process provides the ability to remove oxides from the surface or exposed interiors of a workpiece that is either metal or coated with a metal without the use of a corrosive solution. This allows effective oxide decontamination of surfaces along with the assurance that pitting and other corrosive induced behavior has not been introduced into the metallic material. Further, the effective surface treatment will allow uniform coatings deposited thereon provided from any subsequent processing such as plating or etching.

Additionally, the present invention can extend the life of a decontamination processing liquid including hydrazide ions to complex with inorganic metal ions contained in the processing liquid and thereby minimize industrial processing liquid waste. The complexed hydrazide ions and metal ions carry the complexed metal ions to a cathode where it picks up electrons and plates out as metal. The metal is removed and the solution is decontaminated and its useful life is thus extended. Of course, this feature will also reduce the amount of chemicals introduced into the environment by minimizing the amount of liquid waste that must be handled and disposed therein.

BRIEF DESCRIPTION OF THE DRAWINGS

Other objects and advantages will appear as the description proceeds when taken in connection with the accompanying drawings, in which.

DETAILED DESCRIPTION OF THE INVENTION

Figure 1:
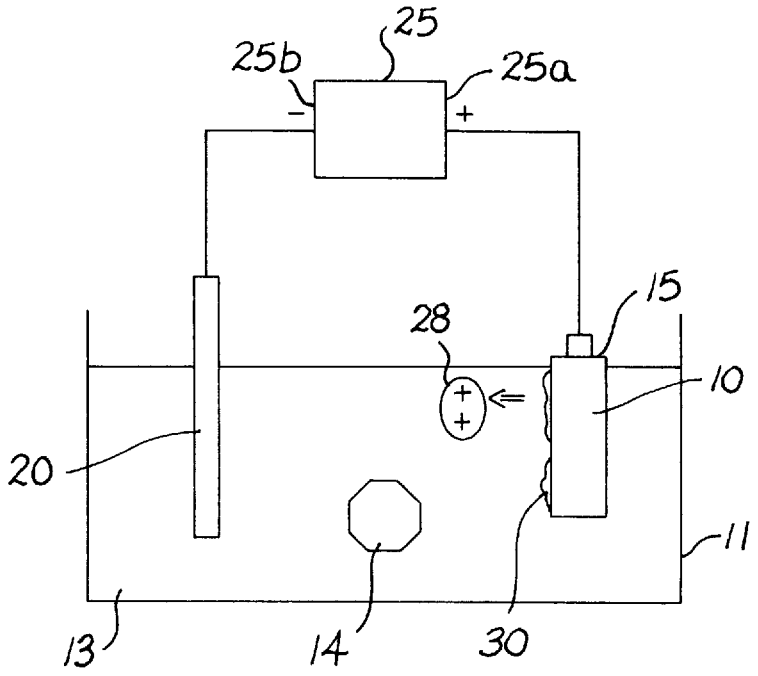
FIG. 1 illustrates a schematic view of an apparatus suitable for a decontamination process with a solution including hydrazide ions and a workpiece contaminated with one or more metal oxides according to a first embodiment of the present invention.

The present invention now will be described more fully hereinafter with reference to the accompanying drawings in which preferred embodiments of the invention are shown. This invention may, however, be embodied in many different forms and should not be construed as limited to the illustrated embodiments set forth herein; rather, these illustrated embodiments are provided so that this disclosure will be thorough and complete and will fully convey the scope of the invention to those skilled in the art. Like numbers refer to like elements throughout.

As described above, the present invention provides a process of decontaminating, by electrochemical attack, metal objects contaminated with metal oxides. As such, the process employs both electrical and chemical processes to produce an ion exchange and chemical reaction to remove metal ions from the liquid solution by depositing the metal ions at the cathode and causing the metal to plate out on the surface of the cathode. The cathode can then be removed with the metal attached thereto. The workpiece and the solution are thus decontaminated. The rate of the decontamination can be altered by a corresponding change in the current input into the ion exchange system. Additionally, after the surface is decontaminated, it can be etched and even plated while suspended in the same solution by known methods. The rate of etching and plating can likewise be controlled by regulating the current input into the apparatus.

Exemplary metal objects that can be decontaminated include, but are not limited to, objects made from carbon steel, stainless steel, copper, aluminum, brass, and alloys. Exemplary metal oxides include but are not limited to cobalt, iron, copper, manganese, chromium, nickel, aluminum, lead, zinc, uranium, plutonium, and the like. Although the metal object or workpiece 10 is illustrated in most of the drawings as a substantially planar object with external surfaces to be decontaminated, it is anticipated that any number of metal objects with any number of geometrically shaped surfaces and configurations are likewise suitable for processing according to the present invention. Of course, various geometries can necessitate system configuration changes such as alternative positioning of the cathode and anode which will be discussed hereinbelow.

The liquid solution is preferably an aqueous solution and preferably includes hydrazide ions. For the purposes of the invention, the hydrazide may include any suitable hydrazide compound, an alkali metal or ammonium salt of the hydrazide compound, or mixtures thereof. The hydrazide functions by complexing or coordinating the metal ions of the metal oxides thereby solubilizing them. The interaction between the liquid solution and the metal oxides weakens the oxide layer and causes more to be removed and solubilized in the solution.

Suitable hydrazides which may be employed include those described, for example, in U.S. Pat. Nos. 4,609,757 and 4,726,907 to D'Muhala et al; and U.S. Pat. No. 4,708,805 to D'Muhala, the disclosures of which are incorporated by reference in their entirety. Typically, hydrazides of an amino polycarboxylic acid are used, e.g., a hydraxide of EDTA. The hydrazide can be a simple hydrazide of hydrazine per se or can be a polycarboxyhydrazide, i.e., a polycarbazic acid produced by reacting the terminal—$NH_2$ groups with alkali metal carbonates. Exemplary polycarbazic acids are of the general formula:

$$(R)_2—N—[CH_2CH_2N(R]_m—R$$

wherein R is the group $CH_2$—CO—NH—NH—COOH and m is 0 or an integer from 1 to 4. Preferably, m is 0 or 1. Another suitable polycarbazic acid includes that described by the general formula:

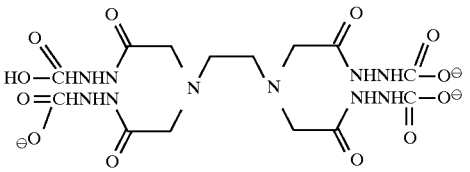

The solution can also comprise various other ingredients such as surfactants, corrosion inhibitors, other acids, e.g., citric acid or oxalic acid, dispersants, and an acid neutralizing agent all of which either separately or in combination typically aid in the cleaning and protection of the workpiece.

Any suitable surfactant or mixtures of surfactant can be used and can be of the non-ionic, anionic, cationic or amphoteric type, and of natural or synthetic origin. Suitable surfactants for use in the present invention include, but are not limited to, nonylphenol alkanolamide, (nonylphenoxy) polyethylene oxide, sorbitan sesquioleate, and mixtures thereof. Preferred surfactants include non-ionic surfactants such as Mazclean EP™ sold by PPG Industries of Gurnee, Ill.; Triton X-100™, a octylphenoxy-polyethyoxyethanol with 9 to 10 moles of ethylene oxide surfactant available from Union Carbide, Danbury, Conn.; and Pluronic L-101™, a polyoxyethylene-polyoxypropylene block polymer surfactant, available from Wyandotte, Mich.

A suitable dispersant for inorganic metal compounds includes sodium lignosulfonate. A suitable corrosion inhibitor is Rodine 95™, which includes thiourea, formaldehyde, o-toluidine and substituted triazine hydrochloric acid, available from Parker+Amchem, Madison Heights, Mich. A suitable citric acid includes alkali metal and ammonium salts of citric acid and mixtures thereof.

Suitable acid neutralizing agents include ammonium hydroxide, amines (e.g., diethanolamine), morpholine, sodium hydroxide, potassium hydroxide, postassium carbonate, and the like. These agents are included to adjust the pH. The various ingredients described above are preferably, but not necessarily, present in the following listed amounts: surfactants from about 0–1% by weight; acids such as citric acid from about 0–15% by weight; dispersants from about 0–1% by weight; acid neutralizing agent from about 0–15% by weight; and 0–1% by weight of a corrosion inhibitor.

In operation, and as best illustrated by FIGS. 1 to 4, a container 11 is supplied with a quantity of cleaning solution 13 including hydrazide ions 14. The metal workpiece 10 which is contaminated with one or more metal oxides is disposed within the liquid solution 13. An anode 15 and cathode 20 are positioned in opposing sides of the container 11. The anode 15 is connected typically via lead wire(s) 21 to a positive terminal 25*a* to provide a positive charge on the anode 15 in the solution 13. In a preferred embodiment, the metal workpiece 10 is the anode 15. However, it will be appreciated that the metal workpiece can merely be attached to a conducting anode 15 to provide a positive charge to fully satisfy the outer electron shell of the surface to be treated on the metal workpiece 10. Likewise, it will be appreciated that the workpiece need not be totally metal, in fact, only the surface which is treated according to the process of the present invention need be made out of a metallic material. Thus, a part that has an accessible layer or coating of metal, has a treatable surface. As such, the workpiece could be disposed within the treating solution and be decontaminated and subsequently etched as the processing dictates.

At least one end of the anode 15 (or metal workpiece 10) is connected to a positive terminal 25*a* of a means for providing direct current 25. As such, the metal workpiece maintains a positive charge and insures that the outer electron shell is satisfied.

The metal ions 28 are emitted from the contaminated surface 30 of the targeted surface 35 including one or more oxides of the metal workpiece 10 into the cleaning or decontamination solution 13 which includes hydrazide ions 14. In effect, the hydrazide ions 14 attract the metal ions 28 off the contaminated surface 30 and away from the workpiece into the solution. This results in a non-corrosive decontamination of the workpiece 10.

Figure 2:
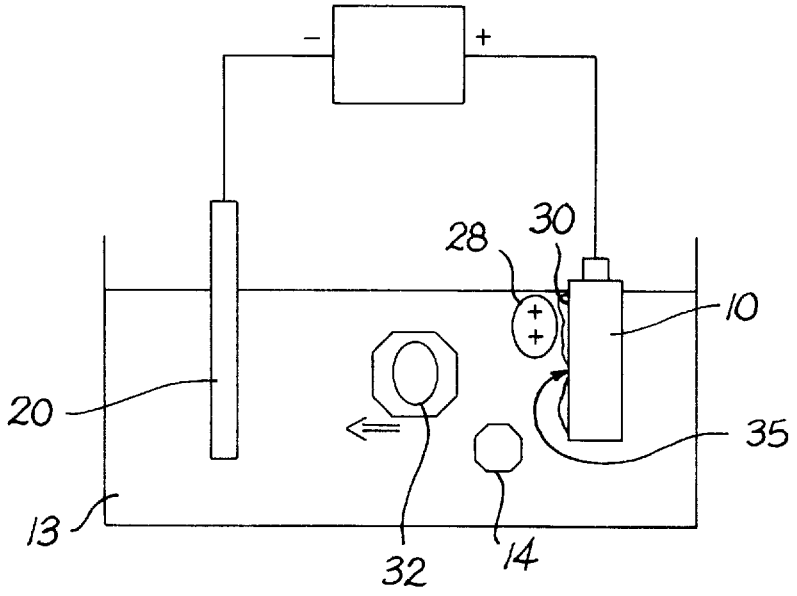
FIG. 2 illustrates a further schematic view of the apparatus of FIG. 1 wherein hydrazide and metal ions and associated flow pattern according to the first embodiment of the present invention.

As best illustrated by FIG. 2, the hydrazide ions 14 subsequently complex 28 or cooridnate to the emitted metal ions 28. The metal ions complexed with hydrazide ions 32 are attracted towards the cathode 20 portion of the container 11. The cathode 20 is connected to a negative terminal 25*b* of a means for providing direct current 25. The means for providing direct current into the circuit and regulating same can include any number power supply sources as is known in the art, including but not limited to a battery and a power supply. The amount of current needed for the process is typically from about one amp to about twenty amps.

Figure 3:
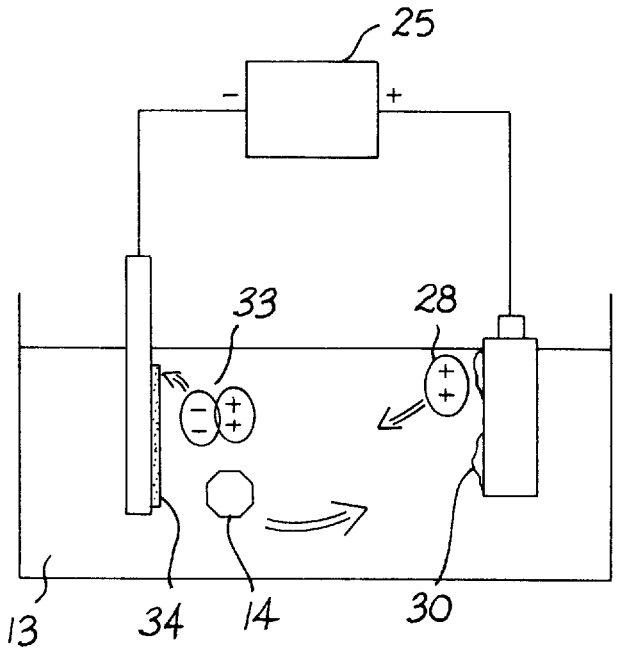
FIG. 3 illustrates a schematic view of complexed hydrazide and metal ions which are transported towards a cathode and a resulting metal plate out at a cathode.

As best illustrated by FIG. 3, to attract the metal ions complexed with hydrazide ions 32 to the cathode 20, direct current (DC) current is input into the system or apparatus. The current is conducted from the anode 15, typically the workpiece 10, through the solution 13 and to the opposing cathode 20. The metal ions complexed with hydrazide ions 32 thus "flow" in the direction of the cathode. As the metal ions complexed with hydrazide ions approach the cathode 20, the negative charge at the cathode causes the hydrazide ions to release the metal ions. The metal ions then bond with the negative electrons 33 emitted by the cathode 20 causing the metal to deposit or "plate out" 34 upon the surface of the cathode.

The metal oxides deposited as metal on the cathode 20 can then be removed from the solution 13. The hydrazide ions 14 are again free to complex with any remaining metal ions 28 emitted from the contaminated surface 30 of the workpiece 10. It is preferred that the container 11 be agitated such as with mechanical or ultrasonic vibrations to aid the decontamination process and promote the chemical and electrical activity on the workpiece 10 and in the solution 13.

Figure 4:
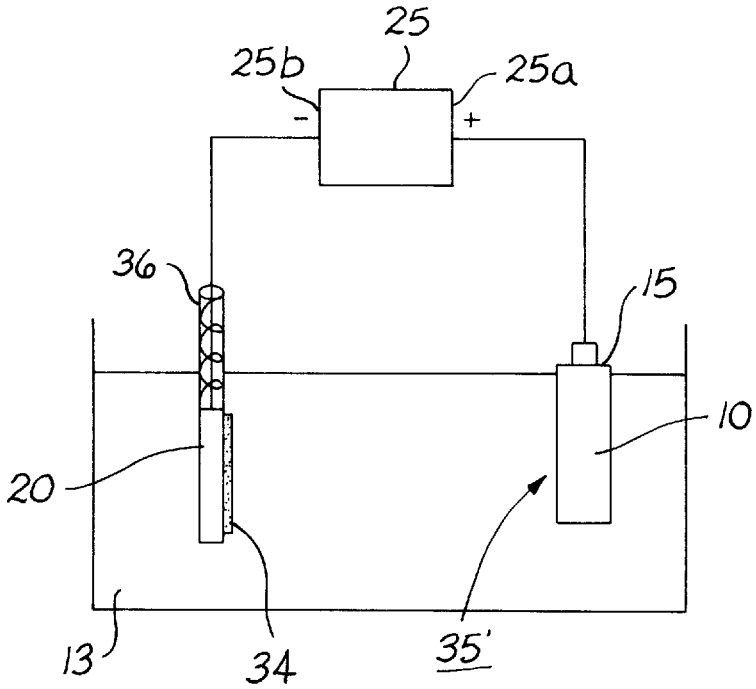
FIG. 4 illustrates a schematic view of a decontaminated workpiece and resulting metal plate out at the cathode.

As illustrated by FIG. 4, the lead wire(s) 21 of the cathode 20 can be shielded 36 to protect it from contacting any undesirable contaminant, deposited metal, or chemicals. Of course, the same protection can be provided for the anode 15 side of the circuit. Also illustrated in FIG. 4 is a workpiece 10 with a decontaminated target surface 35' and a cathode 20 with the metal plated out 34. The surface of the workpiece is decontaminated without exposure to corrosives and without pitting or other undesirable secondary effects. The rate of decontamination can be adjusted either in increasing or decreasing rates by a corresponding increase or decrease in the (DC) input current.

At this point, the workpiece 10 can be further treated, for example, with a surface etch by continuing the current input and adjusting the DC current, such as by increasing the amperage thereto. Surface etching is sometimes desired to provide a good contact surface for any subsequent coatings, such as plating. Either way, the cleaning process of the present invention facilitates uniform plating of the workpiece because the surface is uniformly cleaned or decontaminated and there is no patent or latent pitting or granular attack which is potentially caused by corrosives.

Finally, the system electrodes 15, 20 can reverse polarities to allow the workpiece 10 to be uniformly plated as is known to those of ordinary skill in the art.

Figure 5:
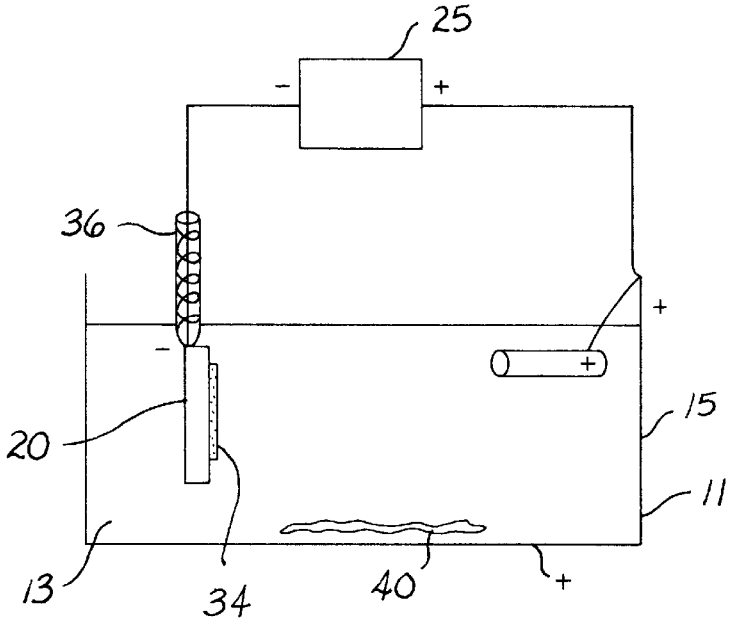
FIG. 5 illustrates an alternative embodiment of an apparatus and process of the present invention wherein a liquid solution contaminated with inorganic metal ions is decontaminated.

In an alternative embodiment, as illustrated by FIG. 5, a solution 13, mixed with a liquid contaminated with inorganic metal ions 40, is the target of the decontamination process. The anode 15 is preferably the container 11, but can also be an additional metal electrode 15*a*, either separate from or in addition to the container. The solution 13 is added to or mixed with a liquid contaminated with inorganic metal compounds 40. The chemical and electrical action is as described above, i.e., the hydrazide ions chelate the inorganic metal compound and a current conducted from the anode to the cathode deposits the metal on the cathode. Thus, instead of removing contamination from and cleaning a workpiece, the process acts to decontaminate the solution/mixture itself. This process, therefore, extends the useful life of the solution 13 and reduces industrial waste and subsequent environmental disposal issues. In addition, the solution 13 is typically biodegradable, non-corrosive, and non-hazardous to personnel. Thus, the process also minimizes potential worker hazardous chemical exposure and saves labor costs associated with set-up and tear-down time involved in replenishing waste liquids contaminated with inorganic metal compounds as well as labor costs related to disposal issues.

Figure 6:
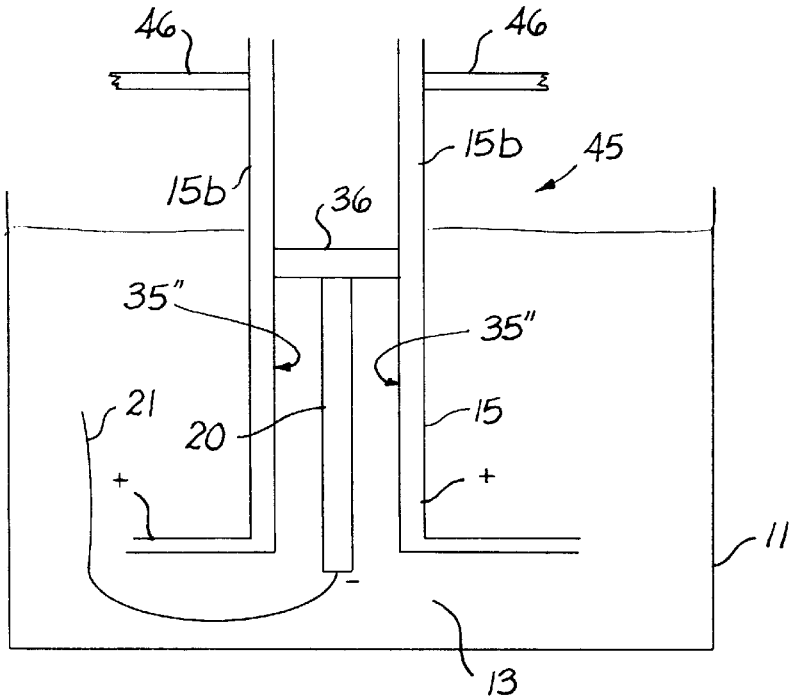
FIG. 6 illustrates an alternative embodiment of a workpiece with internal surfaces to be decontaminated according to the present invention.

In an additional embodiment as illustrated by FIG. 6, the decontamination process of the present invention is employed on the internal surfaces 35" of a tube, such as a steam generator tube 45. Typically, the steam generator tube 45 is suspended by support plates 46 into a container 11. The solution 13 is illustrated by cross hatching in this Figure. The outside walls 15*b* are configured as the anode 15. A cathode 20 is disposed internal to and intermediate of the outside walls 15*b*. An electrical insulator 48 is positioned on the top end of a cathode 20 and extends transversely to contact the outside walls 15*b*. The cathode extends downwardly from the end contacting the insulator 48 into the solution 13 intermediate the outside wall anode 15. The surface area to be treated is the portion of the internal surfaces of the walls 15*a* and is indicated as 35". The electrochemical activity occurs as described hereinabove to decontaminate and subsequently etch and plate as needed. Of course, certain configurations could allow the workpiece to be positioned to be the container and thereby hold the solution. The appropriate electrode configuration could be attached and the process performed therein. Therefore, it will be appreciated that the geometry of the workpiece 10 which can be treated by the present invention include any number of assembly or subassembly components with passageways which can be placed in fluid communication with the solution 13 and connected to the appropriately configured electrodes. As such, the cleaning process is a flexibly adaptable process which can be effectively used to clean industrial hardware.

In the drawings and specification, there have been disclosed typical preferred embodiments of the invention, and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. A process of decontaminating by electrochemical attack, a metal workpiece contaminated with one or more metal oxides, the process comprising the steps of:

(a) placing the metal workpiece contaminated with one or more metal oxides, in a solution including hydrazide ions to complex metal ions of the metal oxides with hydrazide ions, and connecting the metal workpiece to a positive terminal of means for providing direct current;

(b) placing a cathode in the solution including metal ions complexed with hydrazide ions and connecting the cathode to a negative terminal of means for providing direct current;

(c) conducting current from the metal workpiece through the solution including metal ions complexed with hydrazide ions to the cathode; and (d) plating out the metal ion as a metal at the cathode thereby removing the metal oxides from the metal workpiece.

2. The process according to claim 1 wherein step (c) of conducting current includes controlling current to control rate of removing metal oxides from the metal workpiece.

3. The process according to claim 1 wherein the hydrazide is a tetrahydrazide of EDTA.

4. The process according to claim 1 wherein said solution further comprises citric acid.

5. The process according to claim 1 wherein said solution further comprises a surfactant.

6. The process according to claim 1 wherein said solution further comprises a corrosion inhibitor.

7. The process according to claim 1 wherein said solution further comprises a dispersant.

8. The process according to claim 1 wherein said solution further comprises an acid neutralizing agent.

9. The process according to claim 1 further comprising providing turbulence to said solution to agitate said solution.

10. A process of decontaminating by electrochemical attack, an internal surface of a tube contaminated with one or more metal oxides, the process comprising the steps of:

(a) providing a solution including hydrazide ions to complex metal ions of metal oxides with hydrazide ions;

(b) placing the tube having at least one outside wall with a metallic inner surface targeted for surface treatment in said solution, so that the targeted inner surface is in fluid communication with the solution;

(c) connecting the at least one outer wall to a positive terminal of means for providing direct current wherein the at least one outer wall acts as an anode;

(d) providing an insulator positioned in the tube above the solution wherein the insulator extends transversely and contacts said at least one outer wall;

(e) positioning a cathode spaced apart from said at least one outer wall contacting said insulator and extending downwardly therefrom in fluid communication with the solution along a predetermined length corresponding to the targeted surface treatment area and connecting the cathode to a negative terminal of means for providing direct current;

(f) conducting current from the at least one outer wall through the solution including metal ions complexed with hydrazide ions to the cathode; and (g) plating out the metal ion as a metal at the cathode thereby removing the metal oxides from the inner surface of the at least one outer wall.

11. A process according to claim 10, wherein said tube is a steam generator tube.

* * * * *